United States Patent [19]

Langenfeld et al.

[11] Patent Number: 4,968,213

[45] Date of Patent: Nov. 6, 1990

[54] UNIVERSAL TRACTOR LOADER MOUNT

[75] Inventors: Joseph W. Langenfeld; Neal W. Westendorf, both of Onawa, Iowa

[73] Assignee: Westendorf Mfg. Co., Inc., Onawa, Iowa

[21] Appl. No.: 335,723

[22] Filed: Apr. 10, 1989

[51] Int. Cl.[5] ..... E02F 3/34

[52] U.S. Cl. ..... 414/686; 172/275

[58] Field of Search ..... 414/686, 694; 172/272–275

[56] References Cited

U.S. PATENT DOCUMENTS 4,266,906 5/1981 Langenfeld et al. ..... 414/686

4,379,673 4/1983 Takahashi et al. ..... 414/686

4,383,793 5/1983 Weir ..... 414/686

4,797,051 1/1989 Langenfeld et al. ..... 414/686

4,826,389 5/1989 Meyer et al. ..... 414/686

*Primary Examiner*—Robert J. Spar

*Assistant Examiner*—Donald W. Underwood

*Attorney, Agent, or Firm*—Zarley, McKee, Thomte, Voorhees & Sease

[57] ABSTRACT

A universal tractor loader bracket kit is described which enables a basic set of brackets to accommodate various other bracket components thereon to enable the basic set of brackets to accommodate various types of tractor loaders.

4 Claims, 4 Drawing Sheets

UNIVERSAL TRACTOR LOADER MOUNT

TECHNICAL FIELD OF THE INVENTION

This invention relates generally to an universal tractor loader mounting bracket kit assembly or system for a tractor loader which can accommodate various other bracket components to permit different types of loaders to be mounted thereon.

BACKGROUND OF THE INVENTION

Many types of tractor loaders have been designed which utilize a "quick mount" system to rapidly and safely mount the loader on a tractor and to dismount the loader from the tractor. Conventional "quick mount" tractor loaders utilize a mounting bracket assembly which is secured to the tractor and which is adapted to removably receive the loader sub-frame to mount the loader on the tractor.

One problem associated with designing "quick mount" tractor loaders is the vast number of tractor makes and models. For example, some types of tractors are longer than others while other tractors are wider than others. The positioning of the front wheels of the tractor varies between makes and models and the use of mechanical front wheel drive on some tractors causes the front wheels thereof to project further forwardly, though the same frame is used as in the two-wheel drive model. Thus, tractor loader manufacturers must develop and manufacture a vast number of different loaders and a vast number of different mounting bracket assemblies to enable those loaders to be mounted on a particular tractor. For example, see U.S. Pat. Nos. 4,051,926; 4,266,906; and 4,621,973 which represent different approaches taken by Westendorf Manufacturing Co., the assignee of this invention, in mounting loaders on different types of tractors.

It is therefore a principle object of the invention to provide a mounting bracket kit assembly which is adapted to receive different mounting bracket components thereon to accommodate a particular type of tractor loader.

Still another object of the invention is to provide a basic mounting bracket system, and different components therefore, which enables the tractor loader manufacturer to substantially reduce its inventory.

Still another object of the invention is to provide a mounting bracket system for tractor loaders to enable the bracket system to be modified to accommodate various types of tractor loaders.

These and other objects of the present invention will be apparent to those skilled in the art.

SUMMARY OF THE INVENTION

A basic tractor loader universal mounting bracket kit assembly or system is disclosed which is adapted to receive various other types of brackets mounted thereon to permit the assembly to accommodate various types of tractor loaders, thereby eliminating the need for a tractor loader manufacturer or dealer to maintain a large inventory.

A basic set of brackets for mounting on the tractor is provided with the basic set being adapted to receive various configurations of rear mounting tubes at the rear end thereof. The forward end of the basic set is also adapted to receive at least two different types of front mounting brackets. The sides of the basic set are also adapted to receive at least two different types of side mounts.

DESCRIPTION OF THE PREFERRED EMBODIMENTS

Figure 7:
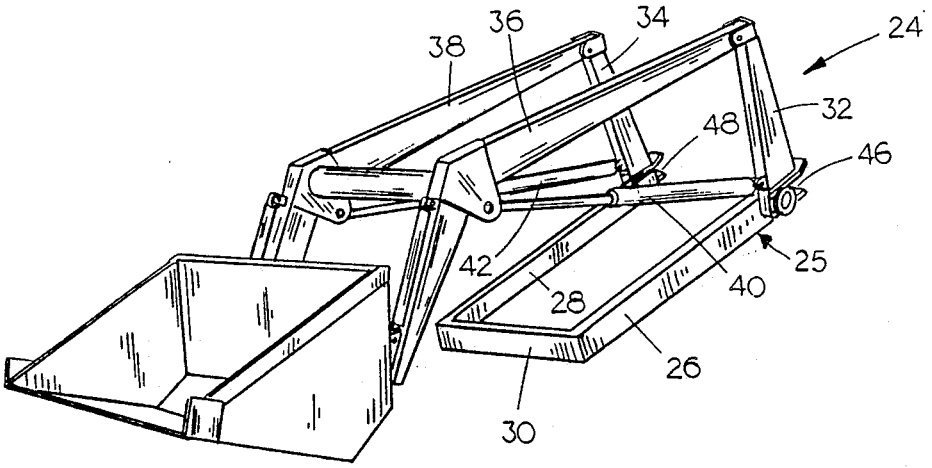
FIG. 7 is a perspective view of one form of a tractor loader.

Referring now to the drawings wherein identical or corresponding parts are identified by the same reference numeral, the numeral 10 generally designates a tractor having a forward end 12, rearward end 14, front wheels 16, rear wheels 18 and opposite sides 20 and 22 (not shown). FIG. 7 illustrates one form of a tractor loader such as illustrated in U.S. Pat. No. 4,051,962. As seen in FIG. 7, tractor loader 24 comprises a U-shaped sub-frame 25 including side frame members 26 and 28, and front frame member 30. Towers 32 and 34 are positioned at the rearward ends of the side frame members 26 and 28 and extend upwardly therefrom as seen in the drawings. Boom arm 36 and 38 are pivotally secured to the upper ends of towers 32 and 34, respectively, and are movable with respect thereto by hydraulic cylinders 40 and 42. A materials handling attachment such as a bucket 44 or the like is pivotally secured to the forward ends of the boom arms 36 and 38 and is pivoted with respect thereto by conventional hydraulic cylinders. The towers 32 and 34 are normally provided with rearwardly presented channels or pockets 46 and 48, respectively, which are adapted to receive cross-mounting tubes so as to detachably secure the rearward end of the loader to the mounting bracket assembly mounted on the tractor, as will be described in more detail hereinafter. Further, the sub-frame 25 is either secured to the front of the mounting bracket assembly or to the sides thereof as also will be described in more detail hereinafter.

Figure 1:
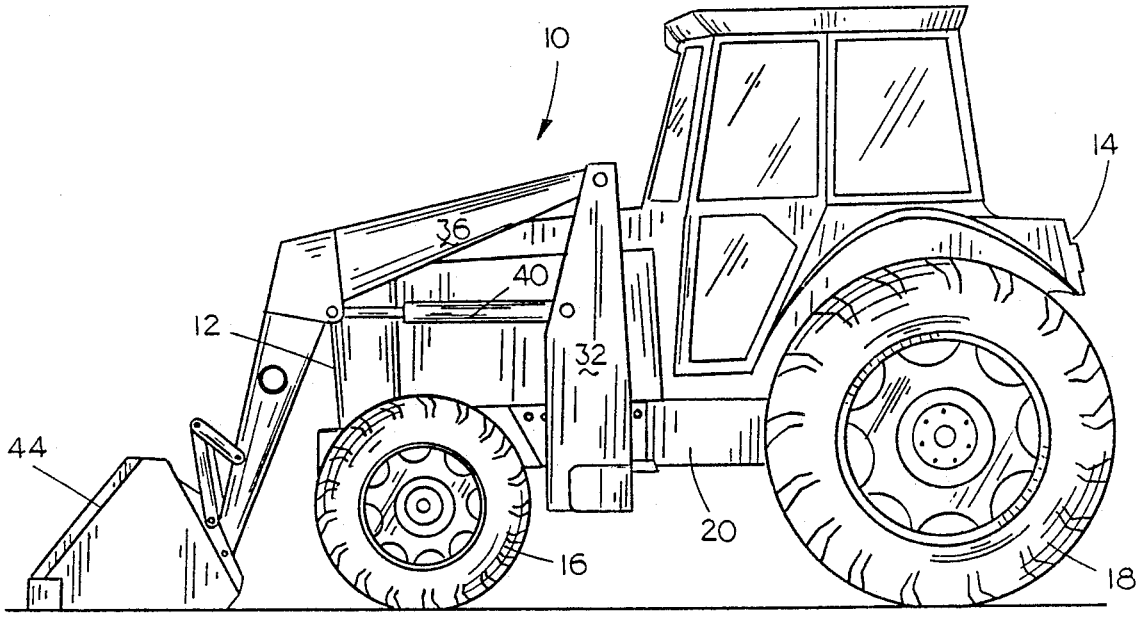
FIG. 1 is a side view of a typical tractor loader attached to a tractor by means of the mounting bracket of this invention.
Figure 2:
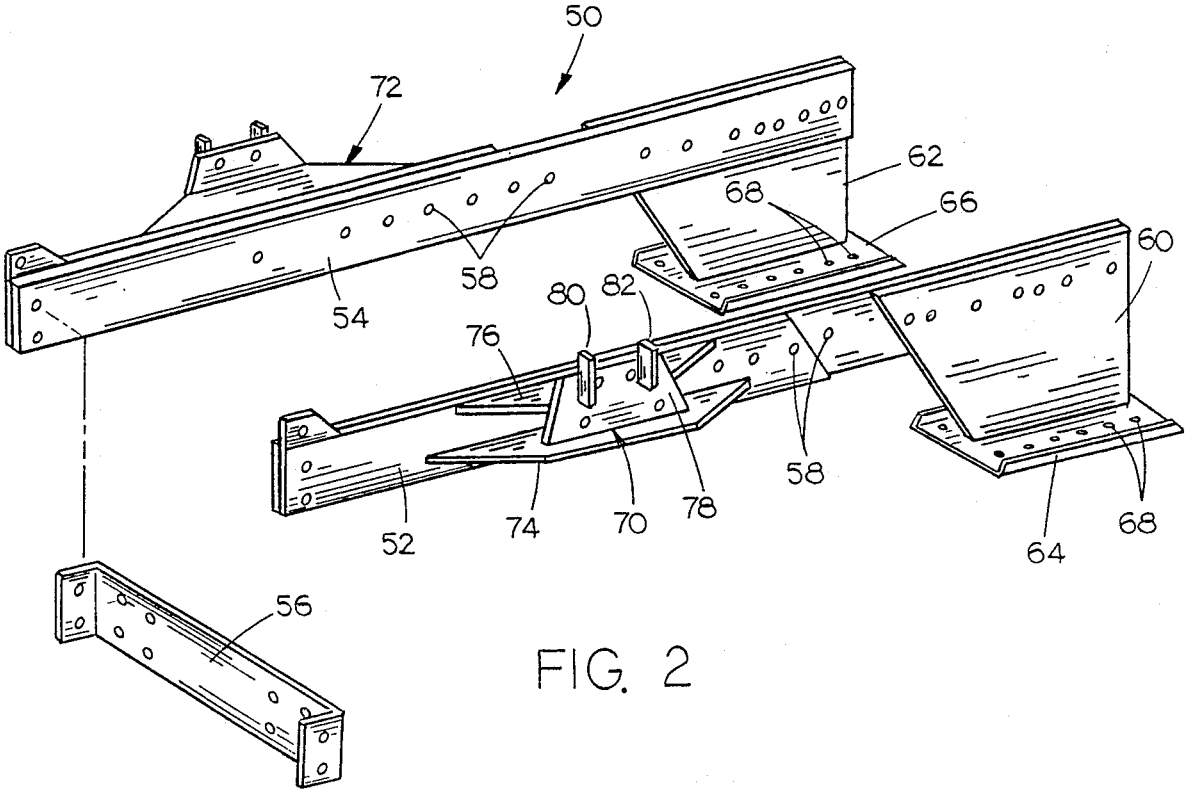
FIG. 2 is a perspective view of the basic mounting bracket assembly of this invention.

FIG. 2 illustrates the basic bracket system or assembly of this invention which is mounted on the tractor and which is referred to generally by the reference numeral 50. Assembly 50 includes a pair of side frame members 52 and 54 having an optional cross or front frame member 56 secured to the forward ends thereof and extending therebetween. In some cases, front frame member 56 is not required. Side frame members 52 and 54 are provided with a plurality of openings 58 provided therein to enable the side frame members 52 and 54 to be bolted to the opposite sides of the tractor.

Hanger plate brackets 60 and 62 are secured to the rearward ends of the frame members 52 and 54, respectively, and extend downwardly therefrom as seen in FIG. 2 and have horizontally disposed plates or shoes 64 and 66 mounted at the lower ends thereof which are provided with a plurality of mounting openings 68 formed therein.

Mounting saddles 70 and 72 are provided on the side frame members 52 and 54, respectively, between the ends thereof as seen in FIG. 2. Inasmuch as each of the saddles 70 and 72 are identical, only saddle 70 will be described in detail. Saddle 70 includes a pair of vertically spaced plates 74 and 76 which extend outwardly from side frame member 52 and which have a vertically disposed plate 78 secured thereto as seen in the drawings. A pair of upstanding spaced-apart lugs 80 and 82 are secured to the exterior surface of plate 78 as seen in the drawings.

Figure 3:
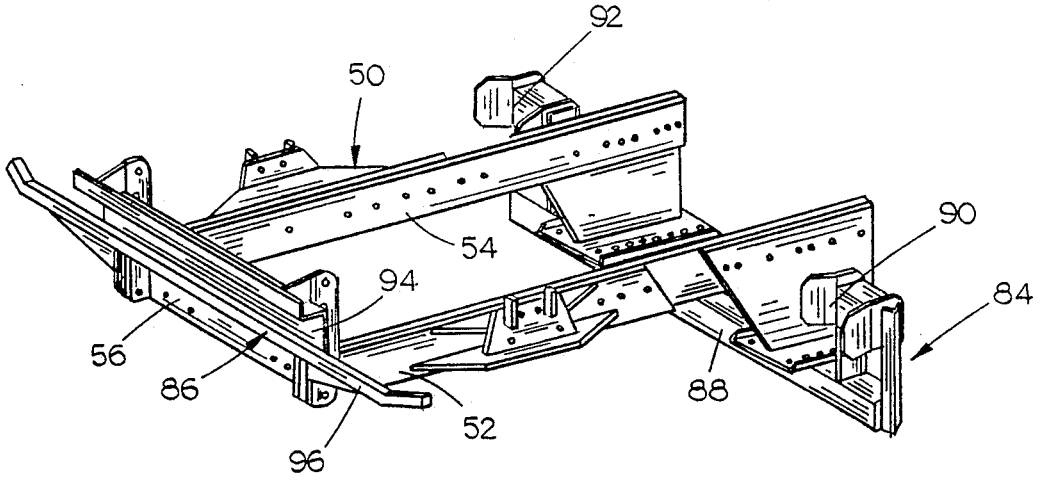
FIG. 3 is a perspective view illustrating a cross member and a sub-frame mounting bracket attached to the basic bracket assembly.

FIG. 3 illustrates the basic bracket assembly 50 having a set of intermediate brackets mounted thereon to accommodate a particular loader. As seen in FIG. 3, bracket assembly 50 has a rear mounting bracket 84 secured thereto and a front mounting bracket 86 mounted thereon. As seen in FIG. 3, rear mounting bracket 84 includes a transversely extending mounting tube 88 which is secured to and which extends beneath the plates 64 and 66. The opposite ends of the mounting tube 88 are provided with forwardly presented pockets or channels 90 and 92, respectively, which are adapted to receive the channels 46 and 48, respectively, at the lower ends of the towers 32 and 34, respectively. As seen in FIG. 3, the front mounting bracket assembly 86 is bolted to the forward ends of the side frame members 52 and 54 and is provided with an elongated, forwardly presented channel 94 which is adapted to receive the front frame member 30 of the sub-frame 25. Front mounting bracket component 86 is provided with a transversely extending pivot bar 96 which projects outwardly from the side frame members 52 and 54 to enable the side frame members 26 and 28 to pivot thereon during the mounting and dismounting operations.

Figure 4:
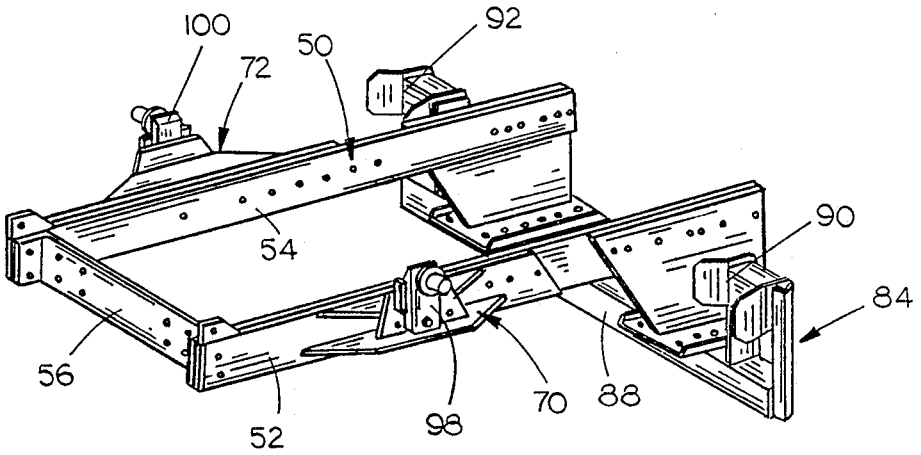
FIG. 4 is a view similar to FIG. 3 but which illustrates the basic bracket system having different bracket components mounted thereon.

FIG. 4 illustrates the basic bracket assembly 50 having a set of intermediate brackets mounted thereon to accommodate a loader of different design than that previously described. As seen in FIG. 4, the basic mounting bracket assembly 50 may also be easily adapted to detachably mount a sub-frame of a tractor loader which does not require a front mounting pocket such as illustrated in FIG. 3. As seen in FIG. 4, a pair of side pivots 98 and 100 are secured to the saddles 70 and 72, respectively, so that the side frame members of the sub-frame of the loader may be pivoted thereover. When the side pivots 98 and 100 are utilized rather than the front receiving pocket as illustrated in FIG. 3, the tractor loader sub-frame is normally either locked onto the side pivots 98 and 100 or the rear pockets to prevent longitudinal movement relative to the mounting bracket assembly.

Figure 5:
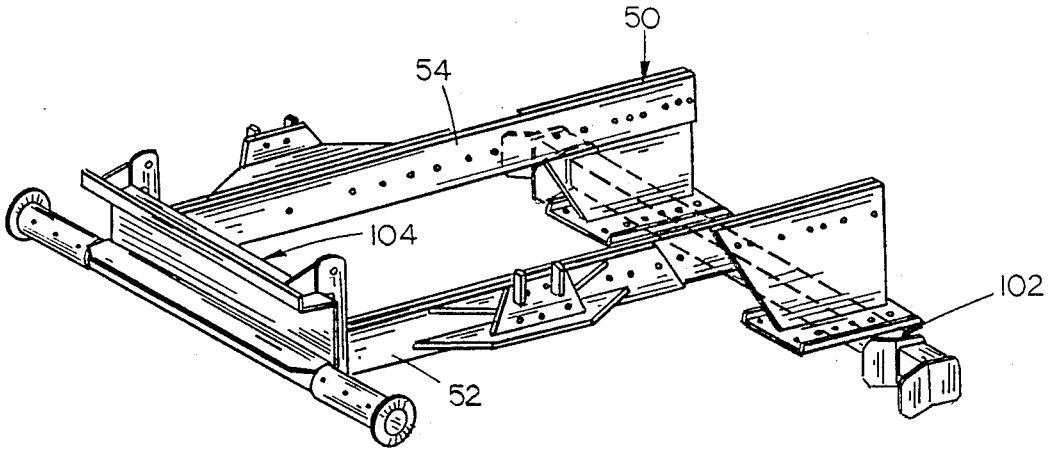
FIG. 5 is a perspective view similar to FIGS. 3 and 4 but which illustrates the basic bracket system having different bracket components mounted thereon.

FIG. 5 illustrates the basic bracket assembly 50 having a set of intermediate brackets mounted thereon to accommodate a loader of different design than that previously described. As seen in FIG. 5, the rear mounting tube 102 in FIG. 5 varies slightly from that illustrated in FIG. 3 and that the front mounting bracket component 104 illustrated in FIG. 5 varies somewhat from that illustrated in FIG. 3.

Figure 6:
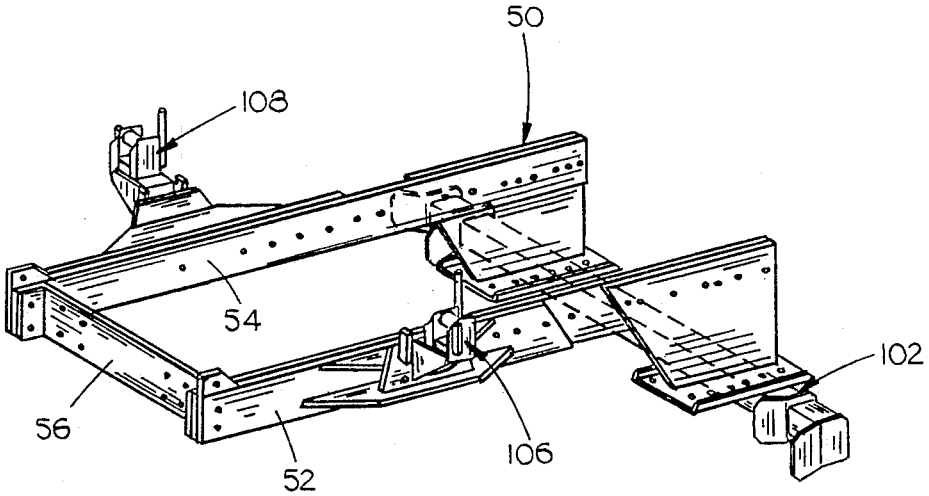
FIG. 6 is a perspective view similar to FIGS. 3, 4 and 5 but which illustrates the basic bracket system having different bracket components mounted thereon.

FIG. 6 illustrates yet another type of adaptation of the basic bracket assembly 50 in that the side pivots 106 and 108 vary in construction from that illustrated in FIG. 4.

Thus it can be seen that a basic mounting bracket assembly 50 has been provided which may accommodate various intermediate bracket assemblies so that the bracket assembly may accommodate different types of tractor loaders thereby achieving the objectives set forth hereinabove.

Thus it can be seen that the invention accomplishes at least all of its stated objectives.

We claim:

1. A universal tractor loader bracket assembly adapted to have various other bracket components mounted thereon to permit the installation of a particular tractor loader thereon, said universal tractor loader bracket assembly including first and second, longitudinally extending side frame members having rearward and forward ends, said first and second side frame members adapted to be secured to opposite sides of the tractor, a substantially horizontally disposed first rear mounting plate means secured to said first side frame member adjacent the rearward end thereof and positioned therebelow, a substantially horizontally disposed second rear mounting plate means secured to said second side frame member adjacent the rearward end thereof and positioned therebelow, said first and second rear mounting plate means adapted to removably receive a transversely extending elongated tubular means extending therebetween and outwardly therefrom and having forwardly presented pockets at the outer ends thereof for removably connecting the rearward end of the tractor loader to the universal tractor loader bracket assembly, the configuration of the elongated tubular means and pockets depending upon the particular type of tractor loader being accommodated, said tractor loader bracket assembly adapted to have mounting means secured thereto forwardly of the said first and second rear mounting plates adapted to removably receive a portion of the tractor loader.

2. A universal tractor loader kit for mounting a tractor loader on a tractor, comprising, first and second longitudinally extending side frame members having rearward and forward ends, said first and second side members adapted to be attached to opposite sides of the tractor, a substantially horizontally disposed first rear mounting plate means secured to said first side frame member adjacent the rearward end thereof and positioned therebelow, a substantially horizontally disposed second rear mounting plate means secured to said second side frame member adjacent the rearward end thereof and positioned therebelow, said first and second rear mounting plate means adapted to removably receive a transversely extending elongated tubular means extending therebetween and outwardly therefrom to enable the rearward end of a tractor loader to be removably secured to the outer ends of the elongated tubular means, a first mounting saddle secured to said first side frame member intermediate the ends thereof adapted to receive a first side pivot of the tractor loader thereon, a second mounting saddle secured to said second side frame member intermediate the ends thereof adapted to receive a second side pivot of the tractor loader secured thereto, said first and second side pivots, when installed upon the side frame members, permitting the tractor loader to engage the same and to pivot thereover during the mounting and dismounting operations, the forward ends of said first and second side frame members adapted to have a cross tube means secured thereto and extending therebetween and outwardly therefrom.

3. A universal tractor loader kit for mounting a tractor loader on a tractor, comprising, first and second longitudinally extending side frame members having rearward and forward ends, said first and second side members adapted to be attached to opposite sides of the tractor, a substantially horizontally disposed first rear mounting plate means secured to said first side frame member adjacent the rearward end thereof and positioned therebelow, a substantially horizontally disposed second rear mounting plate means secured to said second side frame member adjacent there rearward end thereof and positioned therebelow, said first and second rear mounting plate means adapted to removably receive a transversely extending elongated tubular means extending therebetween and outwardly therefrom to enable the rearward end of a tractor loader to be removably secured to the outer ends of the elongated tubular means, a first mounting saddle secured to said first side frame member intermediate the ends thereof adapted to receive a first side pivot of the tractor loader therefrom, a second mounting saddle secured to said second side frame member intermediate the ends thereof adapted to receive a second side pivot of the tractor loader secured thereto, said first and second side pivots, when installed upon the side frame members, permitting the tractor loader to engage the same and to pivot thereover during the mounting and dismounting operations.

4. A universal loader bracket assembly adapted to have various other bracket components mounted thereon to permit the installation of a particular tractor loaded thereon, said universal tractor loader bracket assembly including first and second, longitudinally extending side frame members having rearward and forward ends, said first and second side frame members adapted to be secured to opposite sides of the tractor, a transversely extending support means operatively secured to said first and second side frame members adjacent the rearward ends thereof extending therebetween and outwardly therefrom, the outer ends of said support means having forwardly presented pockets thereon for removably connecting to rearward end of the tractor loader to the universal tractor loader bracket assembly, the configuration of the elongated support means and pockets depending upon the particular type of tractor loader being accommodated, said first and second side frame members adapted to have mounting means secured thereto forwardly of said pockets adapted to removably receive a portion of the tractor loader.

* * * * *